US011413671B2

(12) United States Patent
Alessandrini

(10) Patent No.: US 11,413,671 B2
(45) Date of Patent: Aug. 16, 2022

(54) MANDREL WITH COMPENSATING GRIP

(71) Applicant: Anthony Alessandrini, Crown Point, IN (US)

(72) Inventor: Anthony Alessandrini, Crown Point, IN (US)

( * ) Notice: Subject to any disclaimer, the term of this patent is extended or adjusted under 35 U.S.C. 154(b) by 501 days.

(21) Appl. No.: 16/693,115

(22) Filed: Nov. 22, 2019

(65) Prior Publication Data

US 2020/0164418 A1 May 28, 2020

(51) Int. Cl.

| | |
|---|---|
| ***B21B 39/24*** | (2006.01) |
| ***B21B 17/04*** | (2006.01) |
| ***B21C 47/04*** | (2006.01) |
| ***B21C 47/32*** | (2006.01) |
| ***B65H 75/08*** | (2006.01) |
| ***B65H 75/28*** | (2006.01) |
| ***B65H 18/02*** | (2006.01) |
| ***B65H 16/06*** | (2006.01) |

(52) U.S. Cl.

CPC ..... *B21B 39/24* (2013.01); *B21B 17/04* (2013.01); *B21C 47/04* (2013.01); *B21C 47/323* (2013.01); *B65H 16/06* (2013.01); *B65H 18/028* (2013.01); *B65H 75/08* (2013.01); *B65H 75/285* (2013.01)

(58) Field of Classification Search

USPC ..... 242/573.8

See application file for complete search history.

(56) References Cited

U.S. PATENT DOCUMENTS

| | | | | | |
|---|---|---|---|---|---|
| 1,067,564 | A * | 7/1913 | Warner | B21C 47/30 | 156/429 |
| 2,265,087 | A * | 12/1941 | Tooke | B21C 47/30 | 242/586.5 |
| 2,723,086 | A * | 11/1955 | Russell | B21C 47/323 | 242/575.4 |
| 3,075,720 | A * | 1/1963 | Theobald | B21C 47/30 | 242/576.1 |
| 3,093,338 | A * | 6/1963 | Trapp | B21C 47/30 | 242/586.4 |
| 3,276,715 | A * | 10/1966 | Tsukamura | B65H 75/242 | 242/573.7 |
| 3,815,839 | A * | 6/1974 | Madachy | B65H 75/28 | 242/571.1 |
| 3,854,671 | A * | 12/1974 | Rodach | B65H 75/242 | 242/586.4 |
| 4,280,671 | A * | 7/1981 | Miller | B65H 75/28 | 242/573.8 |
| 5,211,349 | A * | 5/1993 | Sinar | B65H 75/242 | 242/574.1 |
| 2018/0222710 | A1* | 8/2018 | Wahlberg, Jr. | B65H 19/28 | |

FOREIGN PATENT DOCUMENTS

| | | | |
|---|---|---|---|
| DE | 10333004 A1 | * | 4/2004 |
| GB | 987937 | * | 4/1962 |
| GB | 972230 | * | 7/1963 |

* cited by examiner

*Primary Examiner* — William A. Rivera
(74) *Attorney, Agent, or Firm* — Daniel Zamudio

(57) ABSTRACT

A mandrel with a compensating segment, gripper bar, and external body segment making up a key piece configuration. The configuration adjusting the travel path of metal sheet being wound around the mandrel. The metal sheet thereby being wound without resulting imperfections which occur naturally when wrapping material around a cylinder.

8 Claims, 6 Drawing Sheets

MANDREL WITH COMPENSATING GRIP

BACKGROUND

Steel in sheets or other forms have regularly experienced strong markets for use in the United States' industrial sectors. This need has created a need for warehousing and processing of steel sheets.

Historically, in the steel industry, warehousing of steel generally involved the stocking and selling of steel in various shapes and sizes. The warehousers did little or no processing of the steel that was inventoried. Yet, because of growth in the industrial sectors, warehousers quickly began moving into larger buildings.

The need for rolling metal sheets into coils became a natural progression for warehousers because of the large equipment and space needed for coil processing, which the warehousers could accommodate. Mainstream steel manufacturers did not have the technical ability or large equipment needed to wind steel sheets into coils.

All told, the large scale manufacture of sheet material, tinplate, ferrous alloys, tantalum, or steel to name a few examples of sheet material, has been going on since the early 17th century. For example, one process involves making tin, which is extremely malleable, into sheets for making tin cans. The shear number of tin products that get made requires that tin be made into long sheets, rolled, and then delivered in large rolls to the product manufacturers. Specialty metal shops, thin gage metal stamping operations for instance, purchase mandrels, which are large spinning machines, for use in receiving coils of steel and processing them as required.

A mandrel is used for rolling sheets of metal, tinplate for instance. The tin sheet is spun onto the mandrel. The spinning method requires clamping one end of the sheet, then spinning the mandrel so the sheet gets turned around the mandrel several times. The roll of tin sheet is held from inside the hole formed by winding, usually by an outward exertion of force of the mandrel parts. The mandrel spins and adds sheet material and increases the diameter of a coil.

In industry, it is desirable to wind these metal sheet into coils using rapid speeds. High RPMs create pressure on the clamped end of the sheet. Additionally, the heavy nature of the sheet material tugs on the sheet and the mandrel while rolling. Great forces are exerted during the process of rolling steel, for example, onto a mandrel, including those caused by high speeds and heavy weight.

The high speed spinning involved in rolling metal sheets onto mandrels is problematic. Particularly, the forces exerted on the sheets when rolling or unrolling of the sheet material damages the material by spinning it around humps, gripping mechanisms, or other imperfections of the mandrel. In fact, workers talk of a noticeable thumping sound that occurs from spinning coils being wound around such mandrel imperfections. Today, this problem prevents winding of thick gauge metal sheets because the winding results in severe imperfections.

There is a need in the mandrel industry for a new type of mandrel that can minimize or eliminate the damage to metal sheet caused by spinning the sheet around imperfections in today's mandrels. The apparatus should not detract from the mandrel's purpose of winding or unwinding metal sheet at high speeds. Such a mandrel should be usable on thicker materials as well as thinner materials.

SUMMARY

The present invention is directed to an apparatus that satisfies these needs. The apparatus comprises a mandrel with a compensating segment that adjusts according to the thickness of metal sheet that the mandrel is processing.

The apparatus is useful to process, wind and unwind for instance, thicker metal sheet than is possible to do today without creating imperfections. The device provides a useful apparatus for winding metal sheet around a mandrel and virtually eliminating humps in the coil that occur due to imperfections found near the gripping area of present day mandrels.

The invention is an improvement to a mandrel, a clamshell mandrel to name one example, because it virtually eliminates humps, makes the winding process due to humps less noisy, and allows for winding larger thicknesses of metal sheet. Essentially the problem we are solving with this invention eliminates the hump that naturally occurs when wrapping anything around a cylinder.

One version of the inventive mandrel for mounting on an arbor shaft comprises a body segment. The body segment being substantially tube shaped. The body segment having a bore along its longitudinal axis. The body segment being mountable and demountable around the arbor shaft.

At least two hinge segments. The at least two hinge segments each being rectangular and arcuate along its short side. A compensating segment. The compensating segment being rectangular and arcuate along its short side. A gripper bar. An external body segment. The body segment being integral with the external body segment.

The at least two hinge segments, the compensating segment, the gripper bar, and the external body segment being oriented to form a tubelike shell having a diameter larger than that of the body segment. The body segment being substantially located within the tubelike shell. The at least two hinge segments being connected to the body segment. The gripper bar being moveably engaged with the body segment. The gripper bar being movable between a position inward toward the arbor shaft and a position outward away from the arbor shaft along a line substantially perpendicular to the longitudinal axis of the arbor shaft.

The gripper bar being located below and between the external body segment and the compensating segment.

A mandrel of this type could further comprise the compensating grip having a concave side. The body segment having a convex side. At least one gusset being integral with the concave side. At least one rib being integral with the convex side. At least one hole on the gusset. At least one hole on the rib. The at least one hole on the gusset being substantially aligned with the at least one hole on the rib allowing a hinge pin to pass through the substantially aligned holes such that the compensating segment is rotateably connected to the body segment.

Too, a mandrel of this type could further comprise a spring. A first portion of the spring being attached to the compensating segment. A second portion of the spring being attached at a point on the mandrel away from the first portion that allows the spring to exert a force on the compensating segment for moving the compensating segment toward the gripper bar which is located below the compensating segment.

The mandrel could also be such that the convex side is positioned below the outside diameter of the tubelike shell when the gripper bar is positioned inward toward the arbor shaft.

It could be such that the mandrel is a clamshell mandrel.

We envision that this mandrel could also be one where one of the at least two hinge segments is attached to the body segment via the hinge pin.

The inventive mandrel could also comprise a workpiece. The workpiece being metal sheet. Wherein the gripper bar moves between the inward and the outward position, the gripper bar in the outward position gripping a free end of the workpiece between the gripper bar and the external body segment, and the compensating segment pivoting on the hinge pin to accommodate the gripped workpiece.

It is important to understand that the hinge segment, the compensating segment, the gripper bar, and the external body segment are essentially the same length. Though, there is some shortening of the gripper bar because it fits between the retainers on either end. Such retainers are commonly used on mandrels.

Regarding the aforementioned spring, we envision that it rests on the outsides of a bolt and is capable of pulling the compensating and hinge segments in toward the center of the mandrel.

The workpiece mentioned would follow the outer profile of the gripper bar, smoothly bending along the compensating segment, before getting to the full diameter of the tubelike shell. Inserting a workpiece between the gripper bar and the external body segment determines the amount of space exiting between the convex side of the compensating segment and the outside diameter of the tubelike shell, i.e. the outside diameter of the mandrel. This is part of how the inventive mandrel compensates for different thicknesses of metal sheet. So, for instance, thinner sheet needs less space between the convex side of the compensating segment and the outside diameter whereas thicker sheet needs more space. This compensation for thickness is automatically controlled by the gripper bar and compensating segment based on their geometry. We have determined that the best geometry for the gripper bar should include a sloping outside plane, the gripper bar's face, with an offset apex. However, any geometrical configuration will work so long as the desired adjustment for workpiece thickness is achieved.

The imperfection elimination occurs because when the metal sheet wraps toward the first at least one hinge segment, then the metal sheet is at the working outside diameter of the mandrel. More particularly, the compensating effect (from the compensating segment—gripper bar—external body segment configuration) creates a sort of spiral with the first turn of the mandrel, which allows for a more gentle transition between layers of the coil. This continues with each wrap and becomes more and more subtle as the coil grows in diameter (more wraps).

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview

Figure 1:
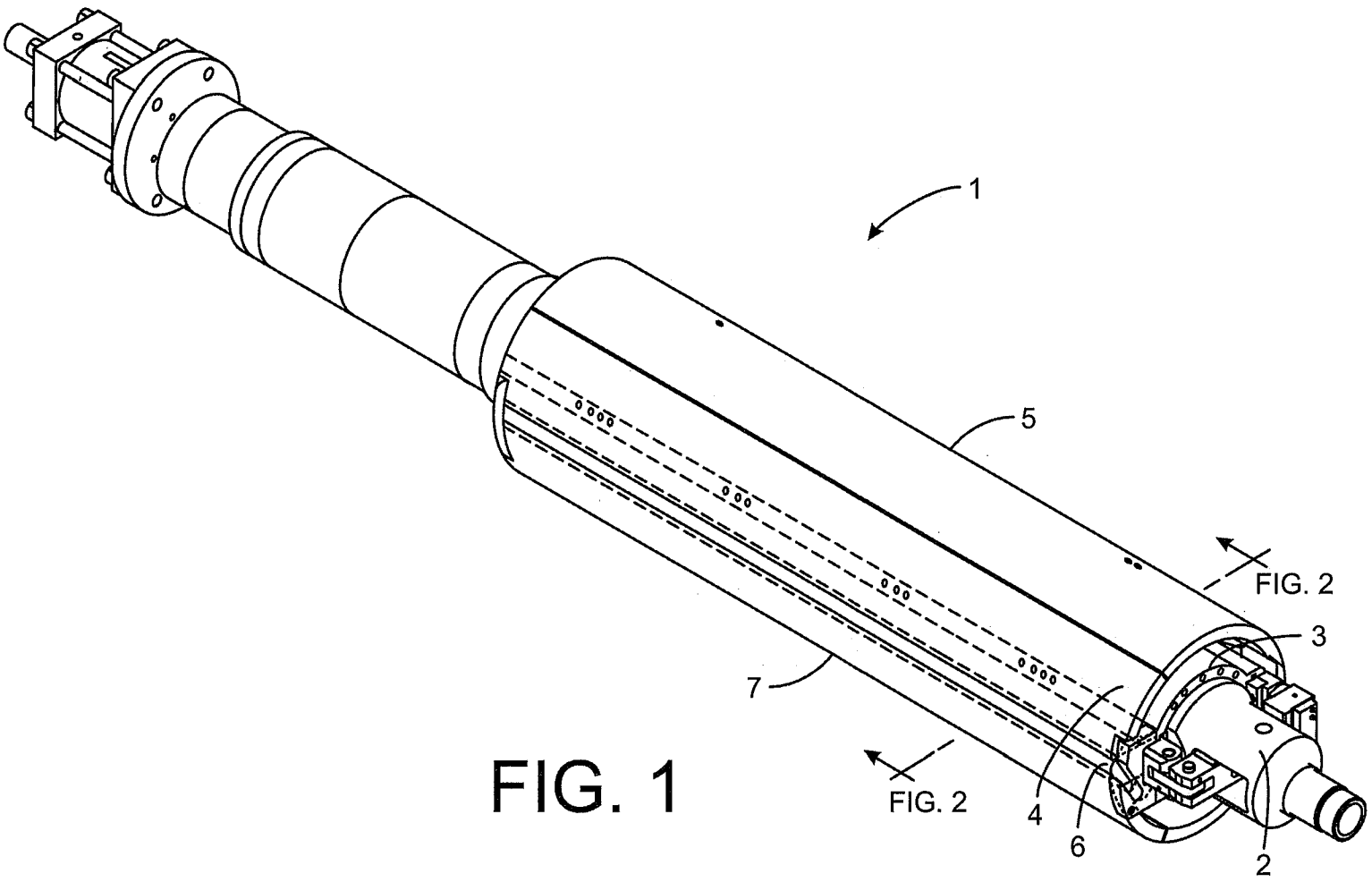
FIG. 1 is a perspective view of an embodiment of an improved mandrel.

FIG. 1 shows a perspective view of an embodiment of an improved mandrel 1 which comprises an arbor shaft 2 surrounded by a body segment 3. The body segment being surrounded by a plurality of hinged segments 5, a compensating segment 4, and an external body segment portion 7. A gripper bar 6 is situated below and between the compensating segment 4 and the external body segment portion 7.

Though the body segment 3 is tube shaped, it can have grooves, slits, channels, and the like along its length to accommodate various parts that are common to a working mandrel. Too, it is interesting to point out that the gripper bar 6 can move in and out from the center of the mandrel. This causes the gripper bar 6 to cooperate with the compensating segment 4 in altering the path around which a metal sheet can be wound; The geometries of those two elements working together.

In this particular embodiment, the mandrel was envisioned to be one that attaches to a pre-existing arbor, arbors generally hold the mandrel in place. Clamshell-style mandrels are usually designed to slip onto the arbor, and applications will require different mandrels that all are mounted and unmounted on one common arbor. This invention of course can work for mandrels that mount/unmount or those that are integrally attached to a mandrel.

Figure 2:
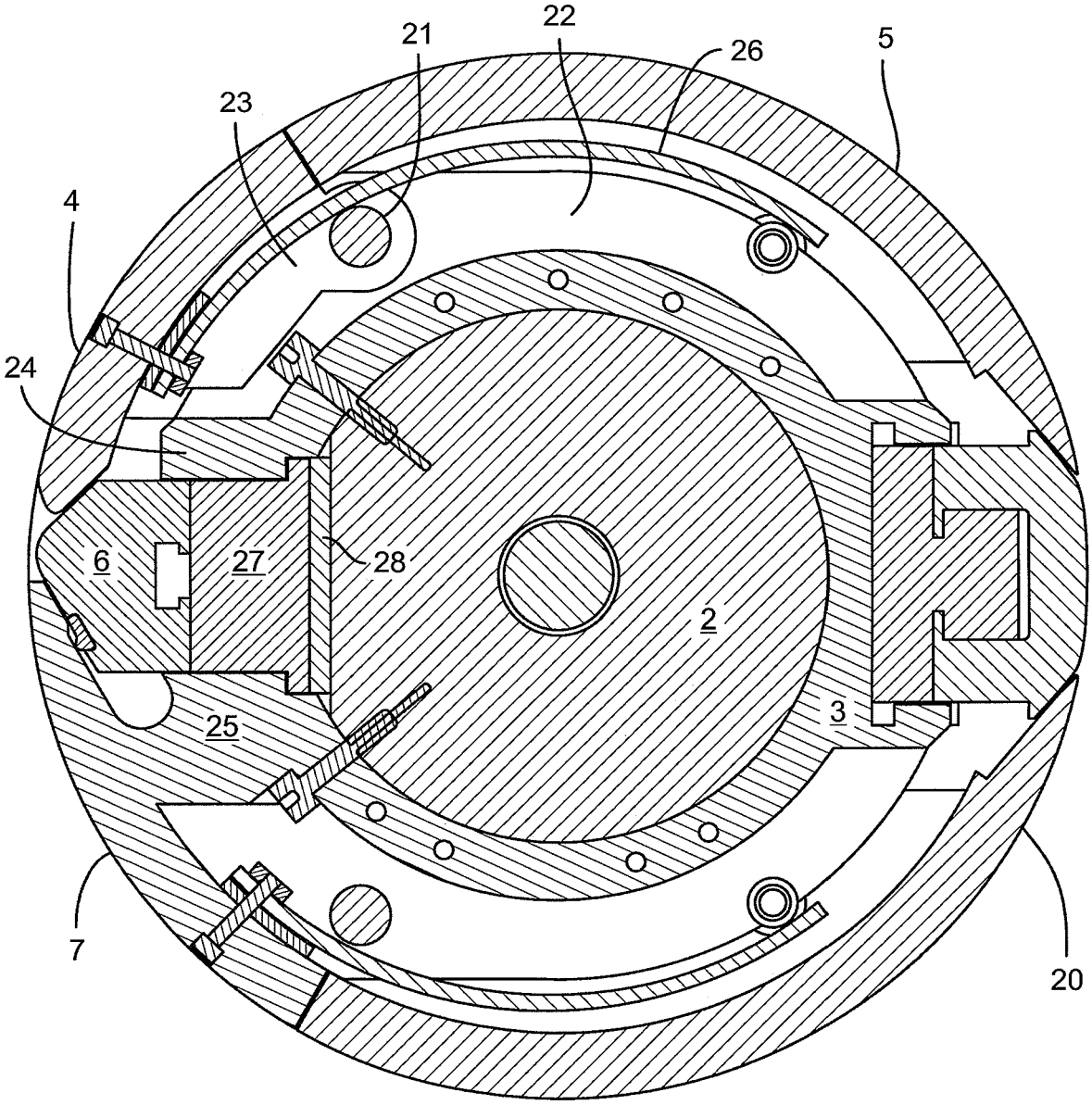
FIG. 2 is a cross sectional view of the improved mandrel along the line 2-2 of FIG. 1.

A shown in FIG. 2, a cross sectional view of the improved mandrel along the line 2-2 of FIG. 1 comprises a plurality of hinged segments 5 and 20, a compensating segment 4 and an external body segment portion 7. A gripper bar 6 is located below the compensating segment 4 and the external body segment portion 7 and between portions 24 and 25 of the body segment 3. Portion 25 is a portion of the body segment that effectively brings a body segment surface from inside to outside the mandrel.

In this embodiment the gripper bar 6 has a lower gripper portion 27 to which it is slide-ably connected and is separated from the arbor by a liner 28. The foregoing pieces surrounding the arbor shaft 2.

The compensating segment 4 is rotate-ably attached to a rib of the body segment 22 via a hinge pin mechanism 21 and gusset portion of the compensating segment 23. The rib of the body segment 22 is part of the body segment which is present but beyond the cutting plane of the section view. The gripper bar 6 can be actuated such that it pushes the compensating segment 4 such that the compensating segment pivots at the hinge pin 21. A commonly known spring mechanism 26 is used to provide tension on the compensating segment, allowing it to move inward and toward the arbor shaft 2.

Figure 3:
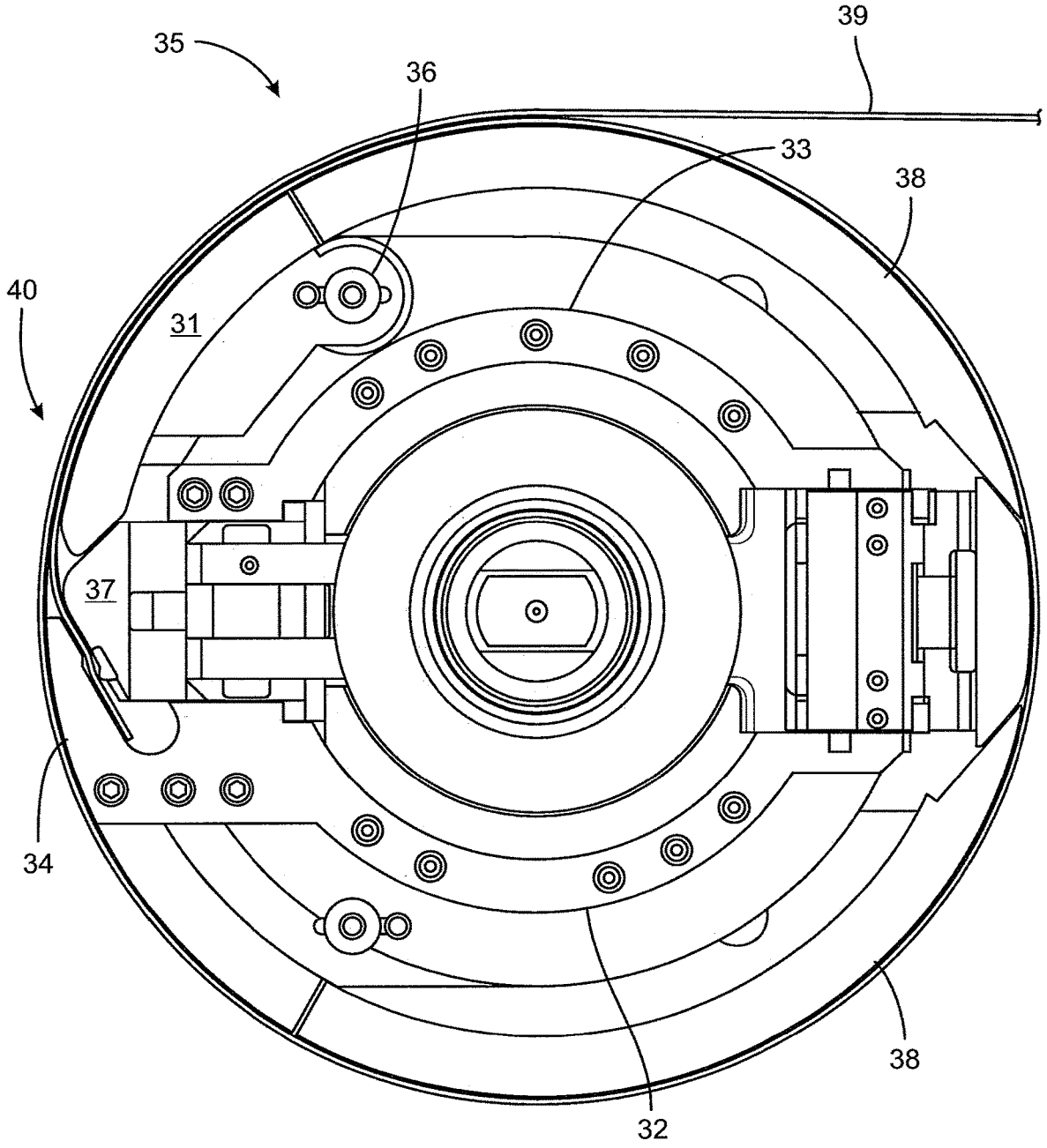
FIG. 3 is a plan view of one end of an embodiment of an improved mandrel.

As shown in FIG. 3, a plan view of one end of an embodiment of an improved mandrel comprises a mandrel 35 with a body segment portion 33 and a second body segment portion 32. A compensating segment 31, an external body segment portion 34, and plurality of hinged segments 38 are located around the body segment portions 33 and 32. A gripper bar 37 is below and between the compensating segment 31 and the external body segment portion 34.

This embodiment depicts a metal sheet 39 being captured between the gripper bar 37 and the external body segment 34. Notably, it can be seen at 40 that the compensating segment 31 pivots at 36 and moves inward toward the center of the mandrel. This movement of the compensating segment 31 eliminates the imperfect nature that would otherwise occur. Thus the sheet 39 winds around the mandrel at this point without traversing any hump or other such imperfections. This solution occurs chiefly because the outermost surface of the compensating segment 31 dips to a position that is below the outermost circumference of the mandrel. This effect is depicted clearly in FIG. 6 showing the compensating segment 31 in that position.

Figure 4:
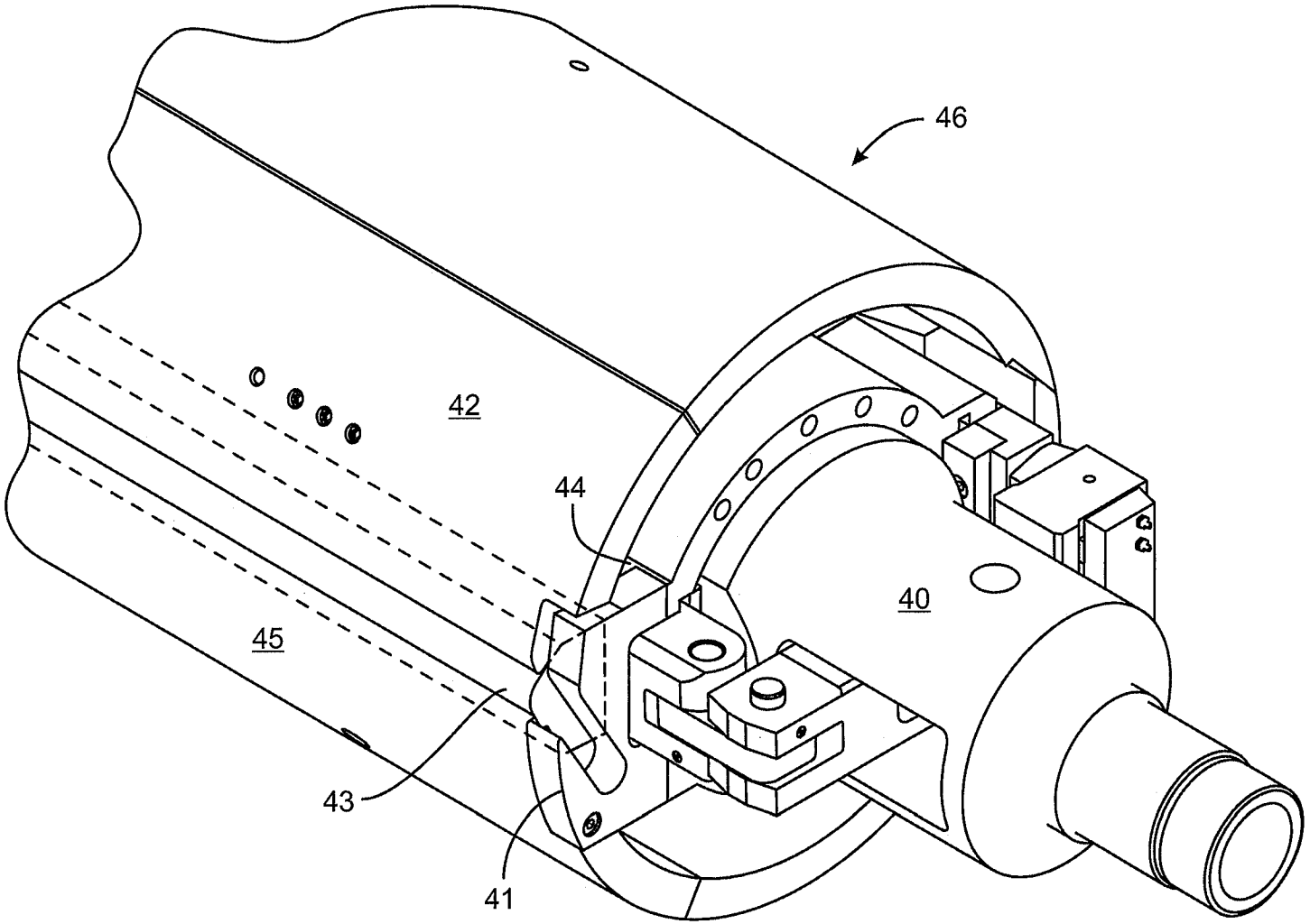
FIG. 4 is a perspective view of one end of an embodiment of an improved mandrel.

As shown in FIG. 4, a perspective view of one end of an embodiment of an improved mandrel 46 comprises an arbor shaft 40 with a surrounding arbor body 44. The arbor body 44 has attached to it, via various pins, slides, and other types of fasteners, a gripper bar 43. The gripper bar 43 being located substantially below and substantially between a compensating segment 42 and an external body segment portion 45. A retainer piece 41 holds the various parts onto the mandrel 46.

Figure 5:
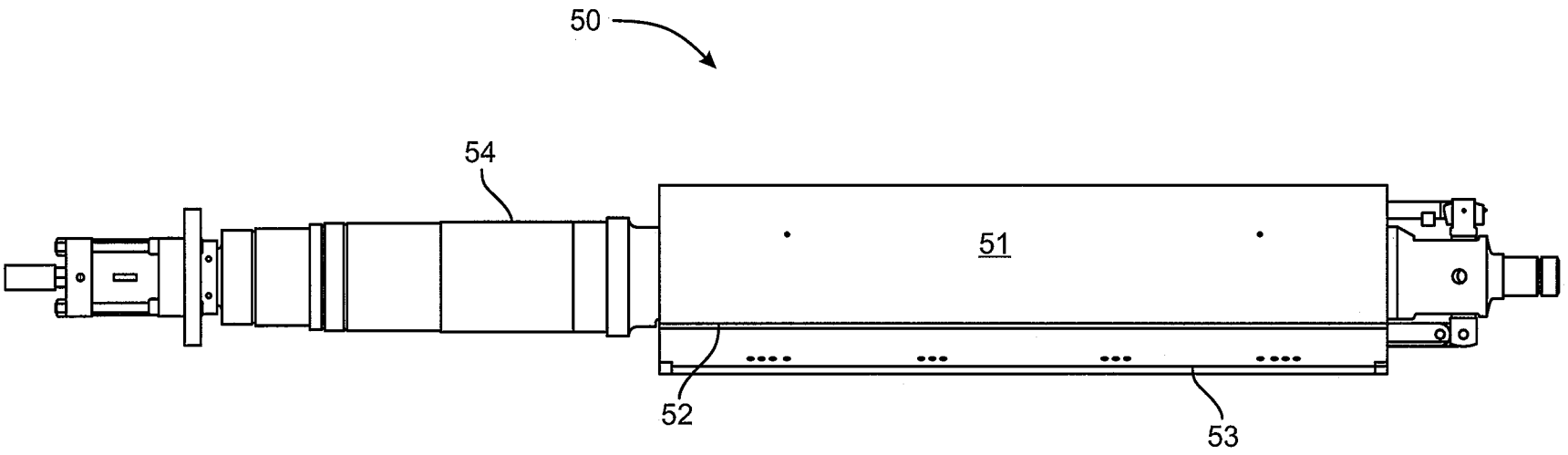
FIG. 5 is a plan view of an embodiment of an improved mandrel showing one side of the mandrel.

As shown in FIG. 5, a plan view of an embodiment of an improved mandrel showing one side of the mandrel 50 comprises an arbor shaft 54, a hinged segment 51, a compensating segment 52 and an external body segment 53. FIG. 5 shows the position of the mandrel parts, the gripper FIG. 4—43 is not shown and is positioned below the compensating segment a 52 and the external body segment 53.

Figure 6:
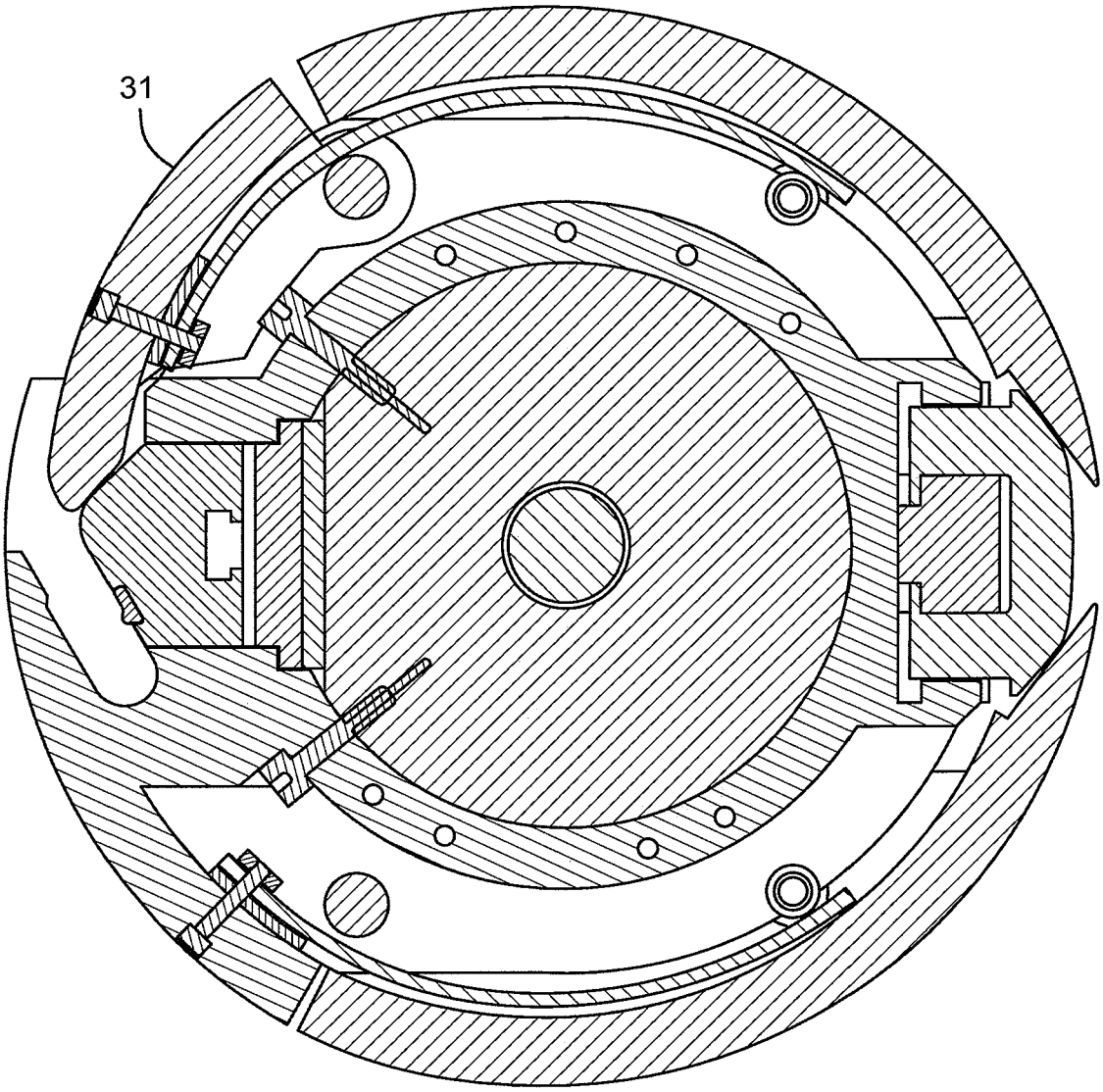
FIG. 6 is a plan view of one end of another embodiment of an improved mandrel.

FIG. 6 is a plan view of one end of another embodiment of an improved mandrel. This figure depicts an alternate position for the compensating segment 31. This depiction makes it clear how the inventive mandrel compensates for a metal sheet being wrapped around at this point on the mandrel. Specifically, the compensating segment 31 can move below the boundary defined by the outside diameter of the mandrel where a metal sheet would be wound.

Although the present invention has been described in considerable detail with the reference to certain preferred versions thereof, other versions are possible. For example, the compensating grip can be located to accommodate clockwise or counter-clockwise spinning of the mandrel. Another possible configuration is where the mandrel and the arbor are integrally attached. Too, a body segment could fully encircle an arbor shaft and still allow for the mechanism that actuates a gripper bar to interact with a compensating segment. Of course, the inventive mandrel is intended to be used on metal sheet but is usable on any sheet material to be coiled that requires a mandrel. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. § 112, ¶ 6. In particular, the use of "step of" in the claims herein is not intended to invoke the provisions of 35 U.S.C. § 112, ¶ 6.

What I claim is:

1. A mandrel for mounting use with an arbor shaft, the mandrel comprising:

a body segment;

the body segment being substantially tube shaped;

the body segment having a bore along its longitudinal axis;

the body segment being mountable and demountable around the arbor shaft;

at least two hinge segments;

the at least two hinge segments each being rectangular and arcuate along its short side;

a compensating segment;

the compensating segment being rectangular and arcuate along its short side;

a gripper bar;

an external body segment;

the body segment being integral with the external body segment;

the at least two hinge segments, the compensating segment, the gripper bar, and the external body segment being oriented to form a tubelike shell having a diameter larger than that of the body segment;

the body segment being substantially located within the tubelike shell;

the at least two hinge segments being connected to the body segment;

the gripper bar being moveably engaged with the body segment;

the gripper bar being movable between a position inward toward the arbor shaft and a position outward away from the arbor shaft along a line substantially perpendicular to the longitudinal axis of the arbor shaft;

the gripper bar being located below and between the external body segment and the compensating segment.

2. The mandrel of claim 1 further comprising:

the compensating grip having a concave side;

the body segment having a convex side;

at least one gusset being integral with the concave side;

at least one rib being integral with the convex side;

at least one hole on the gusset;

at least one hole on the rib;

the at least one hole on the gusset being substantially aligned with the at least one hole on the rib allowing a hinge pin to pass through the substantially aligned holes such that the compensating segment is rotate-ably connected to the body segment.

3. The mandrel of claim 1 further comprising:

a spring;

a first portion of the spring being attached to the compensating segment;

a second portion of the spring being attached at a point on the mandrel away from the first portion that allows the spring to exert a force on the compensating segment for moving the compensating segment toward the gripper bar which is located below the compensating segment.

4. The mandrel of claim 1 wherein the convex side is positioned below the outside diameter of the tubelike shell when the gripper bar is positioned inward toward the arbor shaft.

5. The mandrel of claim 1 wherein the mandrel is a clamshell mandrel.

6. The mandrel of claim 1 wherein one of the at least two hinge segments is attached to the body segment via the hinge pin.

7. The mandrel of claim 1 further comprising:

a workpiece;

the workpiece being metal sheet;

wherein the gripper bar moves between the inward and the outward position, the gripper bar in the outward position gripping a free end of the workpiece between the gripper bar and the external body segment, and the compensating segment pivoting on the hinge pin to accommodate the gripped workpiece.

8. A mandrel for mounting on an arbor shaft, the mandrel comprising:

a body segment;

the body segment being substantially tube shaped;

the body segment having a bore along its longitudinal axis;

the body segment being mountable and demountable around the arbor shaft;

at least two hinge segments;

the at least two hinge segments each being rectangular and arcuate along its short side;

a compensating segment;

the compensating segment being rectangular and arcuate along its short side;

a gripper bar;

an external body segment;

the body segment being integral with the external body segment;

the at least two hinge segments, the compensating segment, the gripper bar, and the external body segment being oriented to form a tubelike shell having a diameter larger than that of the body segment;

the body segment being substantially located within the tubelike shell;

the at least two hinge segments being connected to the body segment;

the gripper bar being moveably engaged with the body segment;

the gripper bar being movable between a position inward toward the arbor shaft and a position outward away from the arbor shaft along a line substantially perpendicular to the longitudinal axis of the arbor shaft;

the gripper bar being located below and between the external body segment and the compensating segment;

the compensating grip having a concave side;

the body segment having a convex side;

at least one gusset being integral with the concave side;

at least one rib being integral with the convex side;

at least one hole on the gusset;

at least one hole on the rib;

the at least one hole on the gusset being substantially aligned with the at least one hole on the rib allowing a hinge pin to pass through the substantially aligned holes such that the compensating segment is rotate-ably connected to the body segment;

a spring;

a first portion of the spring being attached to the compensating segment;

a second portion of the spring being attached at a point on the mandrel away from the first portion that allows the spring to exert a force on the compensating segment for moving the compensating segment toward the gripper bar which is located below the compensating segment;

the convex side is positioned below the outside diameter of the tubelike shell when the gripper bar is positioned inward toward the arbor shaft;

the mandrel being a clamshell mandrel;

one of the at least two hinge segments being attached to the body segment via the hinge pin;

a workpiece;

the workpiece being metal sheet;

the gripper bar being capable of moving between the inward and the outward position, the gripper bar in the outward position gripping a free end of the workpiece between the gripper bar and the external body segment, and the compensating segment pivoting on the hinge pin to accommodate the gripped workpiece.

* * * * *